US009511896B2

(12) United States Patent
Bougoulas et al.

(10) Patent No.: US 9,511,896 B2
(45) Date of Patent: Dec. 6, 2016

(54) THREADED MULTI-COMPONENT CONSUMABLE PRODUCT CONTAINER ASSEMBLY

(75) Inventors: James A. Bougoulas, Chicago, IL (US); Robert J. Peterson, Crystal Lake, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 1834 days.

(21) Appl. No.: 11/673,912

(22) Filed: Feb. 12, 2007

(65) Prior Publication Data

US 2008/0190927 A1 Aug. 14, 2008

(51) Int. Cl.

| | |
|---|---|
| ***B65D 8/00*** | (2006.01) |
| ***B65D 43/02*** | (2006.01) |
| ***B65D 47/08*** | (2006.01) |

(52) U.S. Cl.

CPC ..... *B65D 15/14* (2013.01); *B65D 15/24* (2013.01); *B65D 43/0231* (2013.01); *B65D 47/08* (2013.01); *B65D 2543/00092* (2013.01); *B65D 2543/00296* (2013.01); *B65D 2543/00351* (2013.01); *B65D 2543/00435* (2013.01); *B65D 2543/00527* (2013.01); *B65D 2543/00537* (2013.01)

(58) Field of Classification Search

CPC ... B65D 1/0246; B65D 47/122; B65D 41/08
USPC ..... 220/254.3, 254.2, 319, 256.1, 254.6, 220/254.8, 640–642, 678, 648, 212, 288, 220/639; 206/459.5; 40/310, 311; 215/230, 215/228, 274; 426/106

See application file for complete search history.

(56) References Cited

U.S. PATENT DOCUMENTS

| | | | | | |
|---|---|---|---|---|---|
| 1,782,232 | A | * | 11/1930 | Grande | 426/104 |
| 3,700,133 | A | * | 10/1972 | Bagguley | 215/221 |
| 3,734,393 | A | * | 5/1973 | Stump | 229/5.5 |
| 4,177,904 | A | | 12/1979 | Planas | |
| 4,299,330 | A | * | 11/1981 | Walter | 220/288 |
| 4,412,630 | A | * | 11/1983 | Daenen | 220/792 |
| 5,022,554 | A | * | 6/1991 | Heeter et al. | 220/574 |
| 5,161,711 | A | * | 11/1992 | Picozza et al. | 220/282 |
| 5,213,225 | A | * | 5/1993 | King et al. | 215/330 |
| 5,269,429 | A | * | 12/1993 | Schumacher | B65D 51/002 215/249 |

(Continued)

OTHER PUBLICATIONS

Thermos Web Page—Mugs and tumblers, Thermos LLC, Copyrighted 2006 [printed on May 11, 2007]. Retrieved from the Internet at <URL: http://www.thermos.com/product_catalog.aspx?CatCode=MUGS&SubcategoryID=8>.

(Continued)

*Primary Examiner* — Anthony Stashick
*Assistant Examiner* — Blaine Neway
(74) *Attorney, Agent, or Firm* — Armstrong Teasdale LLP

(57) ABSTRACT

A container is provided for dispensing a plurality of consumable products. The container can include a plastic portion and a metal portion. The metal portion may provide a sophisticated aesthetic to the container while the plastic portion may simplify the manufacturing process. The container may include a housing for housing a plurality of solid consumable products, a lid, an assembly aligning the lid with respect to the housing, and a connection between the lid and the housing. The assembly and the connection may allow indicia on the lid to properly align with indicia on the housing.

22 Claims, 8 Drawing Sheets

(56) References Cited

U.S. PATENT DOCUMENTS

| | | | | |
|---|---|---|---|---|
| 5,938,016 | A | 8/1999 | Erdtmann | |
| 6,779,677 | B2 * | 8/2004 | Chupak | 220/288 |
| 6,913,160 | B2 | 7/2005 | Bourreau et al. | |
| 2001/0054564 | A1 * | 12/2001 | Bethune et al. | 206/459.5 |
| 2004/0118846 | A1 * | 6/2004 | Merolla | 220/254.2 |
| 2006/0163190 | A1 * | 7/2006 | Laveault et al. | 215/257 |
| 2007/0068891 | A1 * | 3/2007 | Rathbone et al. | 215/235 |
| 2008/0047922 | A1 * | 2/2008 | Olson et al. | 215/40 |

OTHER PUBLICATIONS

Thermos Web Page—Food storage, Thermos LLC, Copyrighted 2006 [printed on May 11, 2007]. Retrieved from the Internet at <URL: http://www.thermos.com/product_catalog.aspx?CatCode=FOOD&SubcategoryID=8>.

The Gourmet Kitchen Web Page—Thermos Food Jars, The Gourmet Kitchen, Copyright [printed on May 11, 2007]. Retrieved from the Internet at <URL: http://www.thermosonline.com/jars.htm>.

Photographs of Starbuck and Snap Top Long containers.

* cited by examiner

THREADED MULTI-COMPONENT CONSUMABLE PRODUCT CONTAINER ASSEMBLY

BACKGROUND

The present invention relates generally to packaging, for example containers for storing and dispensing consumable products. There are practical facets to packaging consumable products, namely keeping the products from being damaged during shipping, keeping the products fresh, and in certain instances providing a reusable package. Some consumable products are packaged in a plurality of solid pieces. If it is felt that only some of the pieces may be consumed in one sitting, the manufacturer may wish to provide a container having a lid removable from a housing.

Packaging is also important to the marketing of the product. As such, containers for products such as consumable products come in a variety of sizes, shapes and designs. In marketing the product, packaging can convey information besides taste whereby the consumer can thereby associate the product with its effect by simply viewing the product. Once the consumer has identified a desired brand, the consumer can typically choose a product based solely on the type of packaging.

Very often, in addition to the text of the packaging, the packaging attempts to visually convey a message about the product, the quality of the product, or the purpose of the product. For example, certain packages marketed towards children can include an array of vivid colors, easy to read descriptions, or interactive components to convey an amusing and fun message about the product. Also, certain packages marketed towards adults can include lush fabrics and materials to convey the luxury and quality associated with the product.

In this regard, it is desirable to create a container with an aesthetically pleasing and sophisticated look. It is also desirable to create a container having a secure threaded connection between parts. Conventional metal containers are aesthetically pleasing, but it can be difficult to manufacture threads for various metal components. Furthermore, metal containers with threaded connections can create undesirable scratching noises when opened and closed.

The present invention solves the deficiencies of the prior art.

SUMMARY

The present invention provides a container for dispensing a plurality of consumable products. The container can include a plastic portion and a metal portion. The metal portion provides a sophisticated aesthetic to the container while the plastic portion simplifies the manufacturing process. The present invention also provides a container that can include a receptacle for housing a plurality of consumable products, a lid, and an assembly aligning the lid with respect to the receptacle. The assembly may enable indicia on the lid to line up with indicia on the receptacle.

The present invention provides in an embodiment, a container having a housing and a lid. The housing includes a connector and a receptacle having an interior contacting a plurality of solid consumable products. The connector is made from a non-metal material and has a first portion which extends into the interior of the housing. The receptacle is made from a metal material. The lid is coupled to the connector.

In an embodiment, the receptacle includes an inert coating covering a portion of the metal on the interior of the receptacle. The inert coating may cover about 50% to about 100% of the metal on the interior of the receptacle. The inert coating may be an FDA approved varnish.

In an embodiment, the non-metal material is plastic.

In an embodiment, a connection coupling the first portion of the connector to the receptacle prevents relative rotation between the connector and the receptacle.

In an embodiment, a connection coupling the first portion of the connector to the receptacle allows the first portion of the connector to snap into position to couple with the receptacle.

In an embodiment, a connection removably coupling the connector to the lid includes an outer thread on the connector and an inner thread on the lid.

In an embodiment, a connection coupling the first portion of the connector to the receptacle includes a projection on the first portion and a notch on the receptacle. When the first portion is extended into the interior, the projection corresponds with the notch to prevent relative rotation between the connector and the receptacle.

In an embodiment, a connection coupling the first portion of the connector to the receptacle includes at least one radially extending flange on the first portion and at least one bead on the receptacle. The flange and the bead allow the first portion to snap into position to couple with the receptacle.

In an embodiment, the plurality of solid consumable products is one of a plurality of confectionery products and a plurality of snack foods.

In a further embodiment, a container includes a lid and a housing. The lid has a single inner thread on an inner surface. The housing includes a receptacle and a connector. The receptacle defines an interior contacting a plurality of solid consumable products. The connector has an outer surface defining a single outer thread. The outer and inner threads form a threaded connection for coupling the lid to the housing.

In an embodiment, the lid comprises plastic.

In an embodiment, the receptacle comprises metal.

In an embodiment, the connector comprises plastic.

In an embodiment, a portion of the connector extends into the interior.

In an embodiment, a connection couples the receptacle to the connector.

In an embodiment, a connection prevents relative rotation between the connector and the receptacle.

In an embodiment, a top surface of the lid includes a first indicia. The outer surface of the housing includes a second indicia. The first indicia is oriented with respect to the inner thread and the second indicia is oriented with respect to the outer thread so that the first and second indicia are aligned with respect to one another when the lid is coupled to the housing.

In an embodiment, the plurality of solid consumable products is a plurality of confectionery products or snack foods.

In a further embodiment, a container includes a housing and a lid. The housing is constructed from a metal material and includes an opening and an interior contacting a plurality of solid consumable products. The lid covers the opening and includes a top surface defining a plane that is at an angle with respect to a horizontal plane so as to create a sloped surface.

In an embodiment, the housing includes an inert coating that covers a portion of the metal material on the interior of the housing. The inert coating may comprise an FDA approved varnish.

In an embodiment, the lid is constructed from a plastic material.

In an embodiment, the lid defines at least two openings having different sizes.

In a further embodiment, a method for assembling a container includes the steps of: (a) providing a lid, a connector, a receptacle and a connection for coupling the connector to the receptacle, where the lid is made from a non-metal material and includes an inner thread, the connector is made from a non-metal material and includes an outer thread, and the receptacle is made from a metal material and defines an interior contacting a plurality of solid consumable products; (b) coupling the connector to the receptacle; and (d) twisting the lid onto the connector so as to engage the inner and outer threads.

In an embodiment, the receptacle includes an inert coating that is applied to a portion of the metal material on the interior of the receptacle. The inert coating may comprise an FDA approved varnish.

In an embodiment, the connection prevents relative rotation between the connector and the receptacle.

In an embodiment, the connection allows the connector to snap into position to couple with the receptacle.

In an embodiment, the lid includes a single inner thread and the connector includes a single outer thread.

It is therefore an advantage of the present invention to provide an improved product container.

It is also an advantage of the present invention to provide consumable product container at least partially made of metal for a sophisticated aesthetic.

It is another an advantage of the present invention to provide a consumable product container that is simple to manufacture.

It is yet another advantage of the present invention to provide a consumable product container that is easy to open.

It is a further advantage of the present invention to provide a consumable product container that allows for indicia to be furnished thereon.

Additional features and advantages are described herein, and will be apparent from, the following Detailed Description and the figures.

DETAILED DESCRIPTION

The present invention provides a consumable product container for housing a plurality of solid consumable products. Although in the embodiments illustrated the consumable products are illustrated as tablets of products, it will be understood that the products to be dispensed can be of any suitable shape and size. Examples of such shapes include pill, block, flat stick, pillow, round, rectangular, triangular, and any combination of same. In an embodiment, the products housed in the receptacle may be confectionery products, including such non-limiting examples as hard candies, gummy candies, mints, tablets, gum pellets, beads, liquid filled beads, chewy candy, chocolate, caramels, and gumballs. In another embodiment, the products may be snack foods, including such non-limiting examples as peanuts, nuts, pretzels, and salty snacks.

The products can alternatively be any other type of solid consumable product. For instance, the products can be cough drops or breath mints or other types of medical, consumable products. In an embodiment, the container may include combinations of products. It should also be appreciated that the container may house non-edible products of similar size and shape. The teachings of the present invention, however, are not dependent upon the products being any particular type as long as the products can fit within and be dispensed by the product container described herein.

Figure 1:
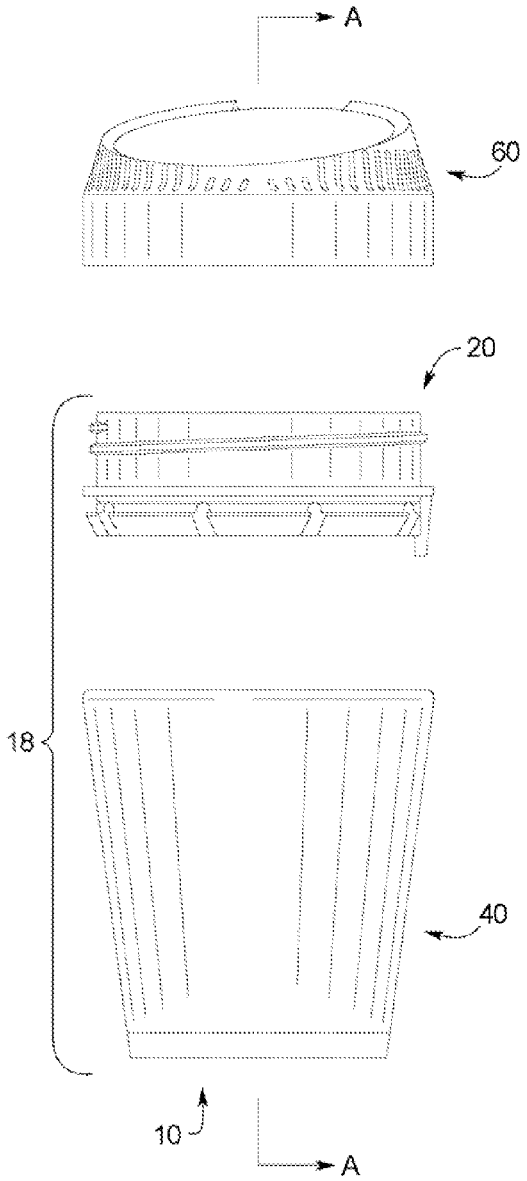
FIG. 1 illustrates a front view of an embodiment of a disassembled container of the present invention.

Referring now to the drawings, and in particular to FIG. 1, one embodiment of a consumable product container is illustrated as container 10. The consumable product container 10 may include a lid 60 and a housing 18 for housing the plurality of consumable products. In an embodiment, the housing 18 may include a receptacle 40 and an insertable connector 20. The lid 60 and the housing 18 may be configured and arranged so as to assemble with one another along axis A-A to form the container 10.

In an embodiment, the lid 60 may be configured as disclosed in commonly-owned co-pending patent application entitled "Two-Piece Container Lid Assembly", U.S. patent application Ser. No. 11/234,496, filed on Sep. 23, 2005 and which is hereby incorporated by reference in its entirety. For example, the lid 60 may generally be made from two pieces: a base and a hinged cover. The lid 60 may include a top surface 70 which defines a plane that is at an angle with respect to a horizontal plane so as to create a sloped surface. In an embodiment, the top surface 70 is sloped with respect to a horizontal plane at an angle between about 10° and about 15°, for example, at an angle of about 12°. The lid 60 can also include at least two openings of differing size for dispensing the consumable products therefrom.

It should be understood that the lid 60 is not limited to being any particular size or shape, as long as the consumable products can be dispensed by the lid described herein. For example, in an embodiment, the top surface 70 of the lid 60 may define a plane that is parallel to a horizontal plane so as to create a flat surface. In another embodiment, the lid 60 may define only one opening for dispensing the consumable products therefrom. Alternatively, the lid 60 may define two or more openings for dispensing the consumable products therefrom. In a further embodiment, the lid 60 may be a unitary piece or may generally be made from more than two pieces.

In addition to the lid 60, the container 10 also includes a housing 18 for housing the consumable products. The housing may include an inner surface 44 contacting the plurality of consumable products and a mouth 42 for providing access to the consumable products. A ridge 58 of the housing 18 may be provided at an opposite end of the housing 18 from the mouth 42. The housing 18 may be any suitable size or shape, including but not limited to cubic, rectangular, pyramidal, cylindrical, conical, spherical, and combinations thereof. In an embodiment, the housing 18 may graduate from one size or shape to another size or shape from the mouth 42 to the ridge 58. For example, in an embodiment, the housing 18 may generally be shaped as a cylinder towards the mouth 42 and as a rectangle towards the ridge 58. However, it will be appreciated that the housing 18 illustrated in the embodiments are not expressly limited to any particular size or shape as long as the products can be accessed from within the housing 18 described herein.

In an embodiment, the housing 18 may be of increased capacity, providing a large amount of consumable products to the consumer to help alleviate product outages. With the increased amount of products, a consumer may be encouraged to share the products with other consumers. The capacity of the housing 18 may also reduce the amount of overall packaging material required for the container 10 with respect to the amount of product provided therein. In this way, the container 10 may house a large amount of relatively small, solid consumable products at the same time. Similar solid consumable products may typically be packaged into smaller packaging relative to the container 10 of the present invention. In this regard, such small packages housing similar consumable products may be placed on impulse racks near the checkout counter at a store. Alternatively, the increased size of the container 10 of the present invention can afford similar solid consumable products with valuable shelf space within the aisles of the store. The entire container 10 may be disposed or reused.

The container 10 may be sized and shaped so as to be portable and ready for use in different environments. For example, the container may be suitable for use in a car, in an office or at home. In an embodiment, the container is sized and shaped to conveniently fit into a standard cup holder, such as the cup holder in a car. The housing 18 may also be sized so as to prevent the container from rattling inside the cup holder. In an embodiment, the housing 18 has an average diameter between about five centimeters and about seven centimeters. In an embodiment, a bottom of the housing 18 at the ridge 58 has a diameter between about five centimeters and about six centimeters, for example, about five and a half centimeters. In another embodiment, a top of the housing 18 at the mouth 42 has a diameter between about five and a half centimeters and about seven centimeters, for example, about six and a half centimeters. In a further embodiment, the housing 18 has a total height between about seven centimeters and about nine centimeters, for example, about eight centimeters.

The lid 60 may be coupled to the housing 18 by a connection. The connection may secure the container so that the container may not open when dropped or agitated. For example, the container may not undesirably open when dropped from at least thirty-six inches or when agitated inside a purse or bag. The container may be sufficiently rigid to prevent the container from deforming or opening when squeezed. Moreover, the connection also serves as a guide for ensuring proper alignment when assembling the container.

Figure 2:
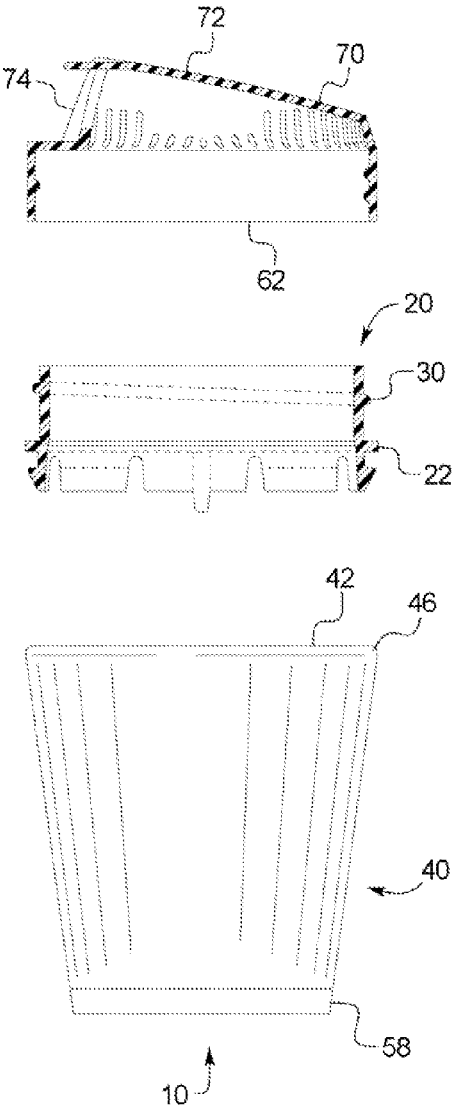
FIG. 2 illustrates a side view of the container of FIG. 1 along line A-A.
Figure 10B:
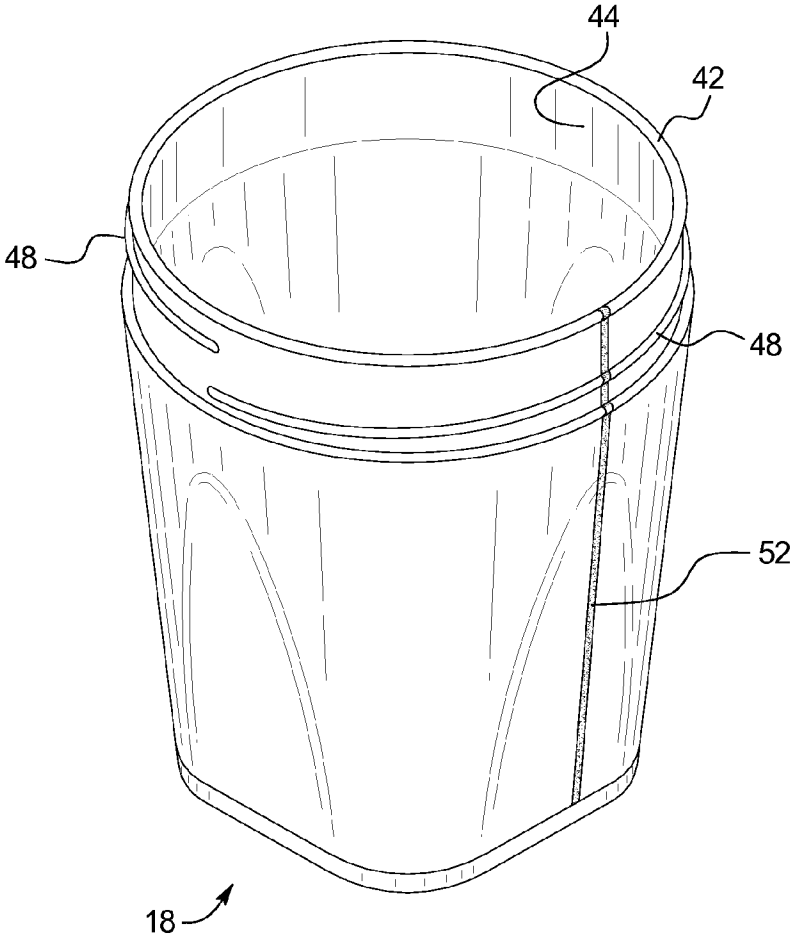
FIG. 10B illustrates a top perspective view of the receptacle of FIG. 10A.
Figure 10A:
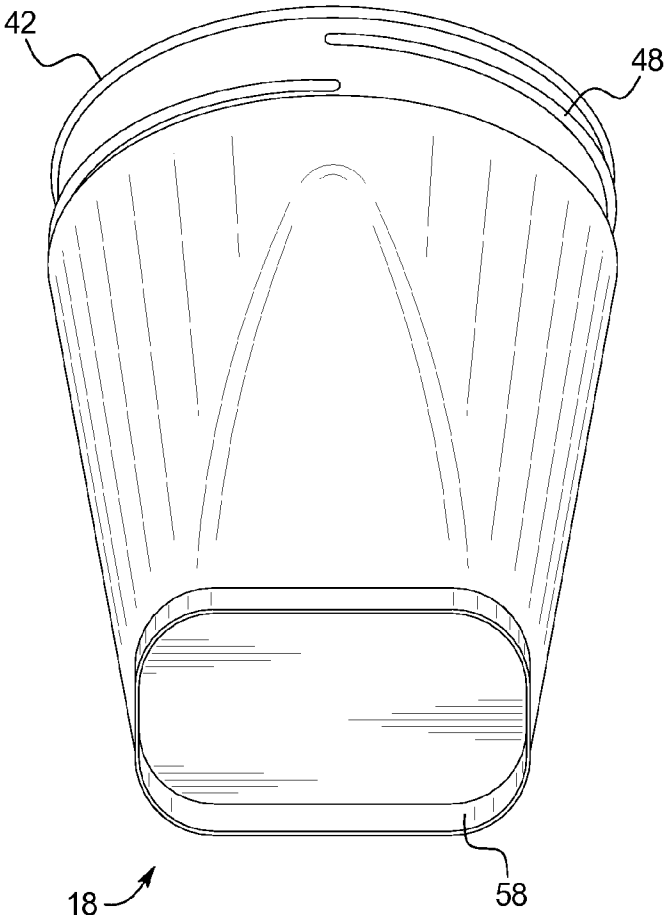
FIG. 10A illustrates a bottom perspective view of another embodiment of the receptacle of the present invention.

In an embodiment, the connection includes a set of threads between the lid 60 and the housing 18 so as to form a threaded connection between the lid 60 and the housing 18. The lid 60 may be twisted onto the housing 18 so as to engage the set of threads. The lid 60 may include an inner thread 66 on an inner surface 64 of the lid 60. In an embodiment, the inner thread 66 is located on the underside of the base of the lid 60. Similarly, the housing 18 may include an outer thread 30 or 48 on an outer surface of the housing 18. In an embodiment, an outer thread 48 may be included on an outer surface of a unitary housing 18, as shown in FIG. 10A and FIG. 10B. In another embodiment, an outer thread 30 may be included on an outer surface of an insertable connector 20, as shown in FIG. 2. In an embodiment, the inner and outer threads can each have a radius of curvature of about half a millimeter. In a further embodiment, the connection can involve a single set of threads, for example, a long single thread on the lid and a long single thread on the housing. In another embodiment, the connection can involve more than one thread on the lid and more than one thread on the housing.

As shown in FIG. 2, an embodiment of the housing 18 may include a receptacle 40 and an insertable connector 20. The insertable connector 20 can best be viewed in FIGS. 3 through 6 while the receptacle can best be viewed in FIGS. 7 through 9.

The container may be made from disposable materials. The present invention expressly includes the receptacle and lid being made of any suitable material including such non-limiting examples as plastic, metal, paper, and combinations thereof. More specifically, the housing 18 and lid 60 illustrated in the embodiments described below can be generally made of several materials such as a plastic material 34 and a metal material 54.

The plastic material 34 may be polyethylene, polypropylene, or the like, or combinations thereof. Parts of the container made from the plastic material 34 may be constructed using conventional molding processes, including such non-limiting examples as injection blow molding, extrusion blow molding, injection molding, and thermoforming. The plastic material 34 allows for an easier, more efficient manufacturing process since plastic can be molded into complex shapes (e.g. threads) within a limited number of manufacturing steps.

The metal material 54 may be tin, aluminum, steel, tempered steel, or the like, or combinations thereof. Parts of the container made from the metal material 54 may be constructed using conventional metal processes, including such non-limiting examples as punching, rolling, shaping and welding. The metal material 54 may include sheet metal. Forming sheet metal into complex shapes can involve a number of distinct processing steps. However, the metal material can provide a sophisticated aesthetic to the container 10.

In an embodiment, the metal material 54 may be coated with an inert coating 58 to prevent the metal material 54 from contacting consumable products contained within the receptacle 40. The inert coating 58 may be any coating that is approved by the Food and Drug Administration (FDA) for use with consumable products. Specifically, the inert coating 58 may be an FDA approved varnish. Alternatively, the inert coating 58 may be any material that serves as an inert coating, thin film, inert layer, or the like, or combinations thereof, intermediate the metal material 54 and the consumable products. The inert coating 58 may have a thickness from about 0.1 mm to about 1.0 mm, or any value therebetween. Similarly, the inert coating 58 may have a thickness of about 0.5 mm.

The inert coating 58 may be applied to the metal material 54 prior to cutting or forming of the metal material 54 or may be applied to the metal material 54 after cutting and forming of the metal material 54. The inert coating 58 may be rolled onto the metal material 54, sprayed onto the metal material 54, applied to the metal material 54 via a waterfall technique, or may be applied to the metal material 54 by any other means of applying coatings, layers or thin films known in the art. The inert coating 58 may be applied to the metal material 54 on a side of the metal material 54 that will become the interior of the receptacle 40. Alternatively, the inert coating 58 may be applied to both sides of the metal material 54. The inert coating 58 may cover about 50% to about 100%, or any value therebetween, of the metal material 54 on the interior of the receptacle 40. Additionally, the inert coating 58 may cover about 75% of the metal material 54 on the interior of the receptacle 40. Similarly, the inert coating 58 may cover about 100% of the metal material 54 on the interior of the receptacle 40.

The lid 60 may involve several materials. For example, the entire lid 60 may be made from the plastic material 34. Alternatively, a first part of the lid (e.g. a base) may be made from the plastic material 34 while a second part of the lid (e.g. a cover) may be made from the metal material 54.

The housing 18 may involve several materials as well. For example, the housing 18 may be made from a unitary piece of the metal material 54, as shown in FIG. 10A and FIG. 10B. In an embodiment, the housing can include a side weld 52. Alternatively, a portion of the housing can be made from the metal material. In another embodiment, the housing can be made from the plastic material 34.

In another embodiment, the housing can include the metal material 54 and a non-metal material. For example, the housing 18 can include a receptacle 40 made from the metal material 54 (e.g. tin) and an insertable connector 20 made from a non-metal material (e.g. plastic). As discussed above, the lid 60 can be made from any suitable material, including non-metal materials (e.g. plastic). When it is desirable to manufacture a housing from the metal material and a lid from a non-metal material, a connector 20 made from a similar non-metal material as the lid can extend into the receptacle and couple with the lid. In other words, a non-metal connector 20 can serve as an adapter between a metal housing and a non-metal lid.

Regardless of the materials used, the lid 20 may be coupled to the housing 18 by the threaded connection discussed above. In an embodiment, the threaded connection includes an outer thread 48 on a metal housing 18 and an inner thread 66 on a plastic lid 60. In another embodiment, the threaded connection includes an outer thread 30 on a plastic connector 20 and an inner thread 66 on a plastic lid 60. Providing a threaded connection between two plastic parts can reduce the noise or scratching between the threads when the lid 60 is twisted onto the housing 18. Furthermore, the plastic material can also lower the application force required for a consumer to twist the lid 60 onto the housing 18.

Figure 3:
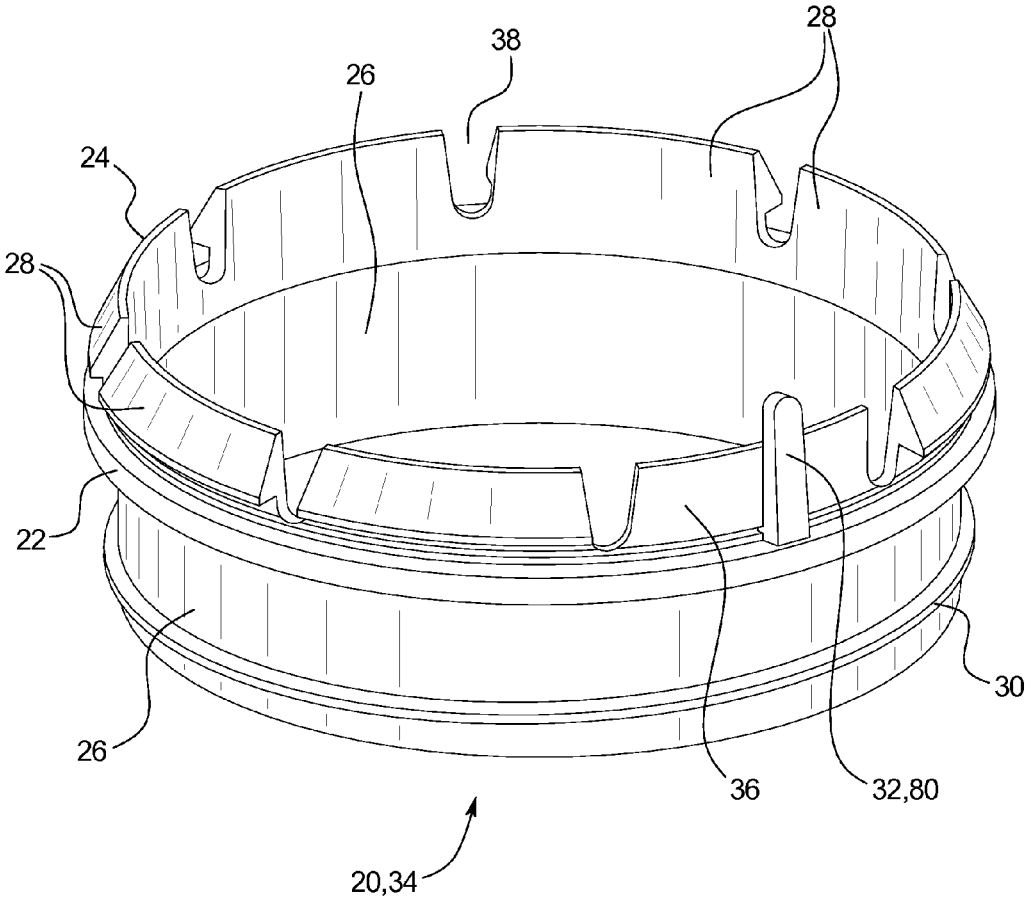
FIG. 3 illustrates a perspective view of one embodiment of the insertable connector of the present invention.

FIG. 3 illustrates a perspective view of the insertable connector 20. The connector 20 can include an outer surface and a generally smooth inner surface. On the outer surface, an annular ring 22 separates a first end 24 of the connector 20 from a second end 26 of the connector. An outer thread 30 may be defined along an outer surface of the second end 26. As discussed above, the outer thread can be used to couple the connector 20 to the lid 60. In this regard, the second end 26 of the connector can be configured and arranged so as to insert inside the lid 60 until the annular lip 62 of the lid 60 engages the ring 22 of the connector 20. In an embodiment, the connector 20 has a diameter approximately equal to the diameter of the housing 18 at the mouth 42. In another embodiment, the connector has a total length of about two centimeters. In an embodiment, each of the first and second ends 24, 26 has a maximum length of about one centimeter.

Figure 4A:
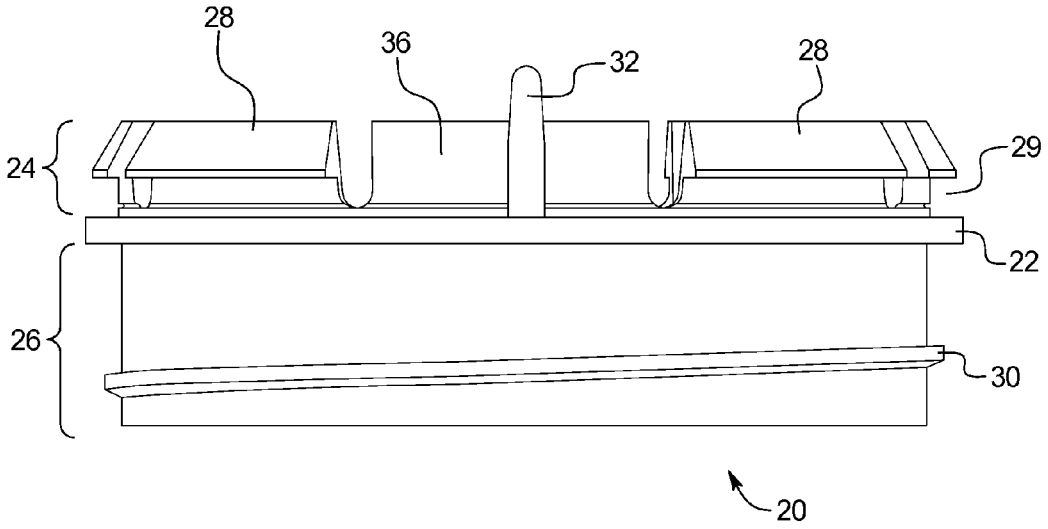
FIGS. 4A and 4B illustrate front views and back views of the connector of FIG. 3 respectively.
Figure 4B:
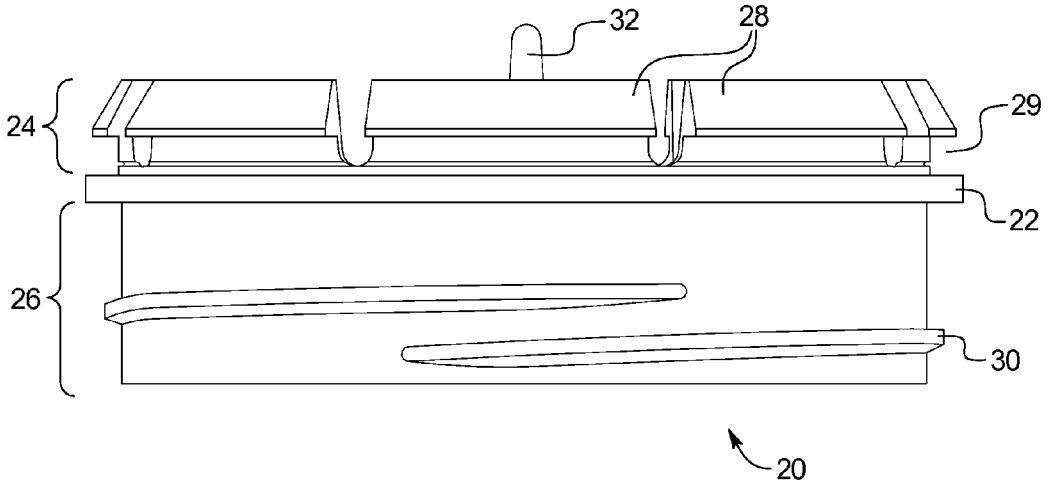

The second end 26 of the connector is located on an opposite side of the annular ring 22 from the first end 24. At least one flange 28 or a plurality of flanges 28 can be defined along a circumference of the first end 24. Individual flanges 28 can be spaced apart from one another by at least a length of one interstice 38. The flanges 28 are configured and arranged to resiliently deform in the radial direction so as to extend inwardly with respect to a center of the connector 20. As shown in FIGS. 4A and 4B, the flanges 28 and the annular ring 22 cooperate to define a channel 29 therebetween. In an embodiment, the channel can be about two millimeters wide and the flanges 28 can protrude up to about half a centimeter long from the rest of the first end 24.

Figure 7:
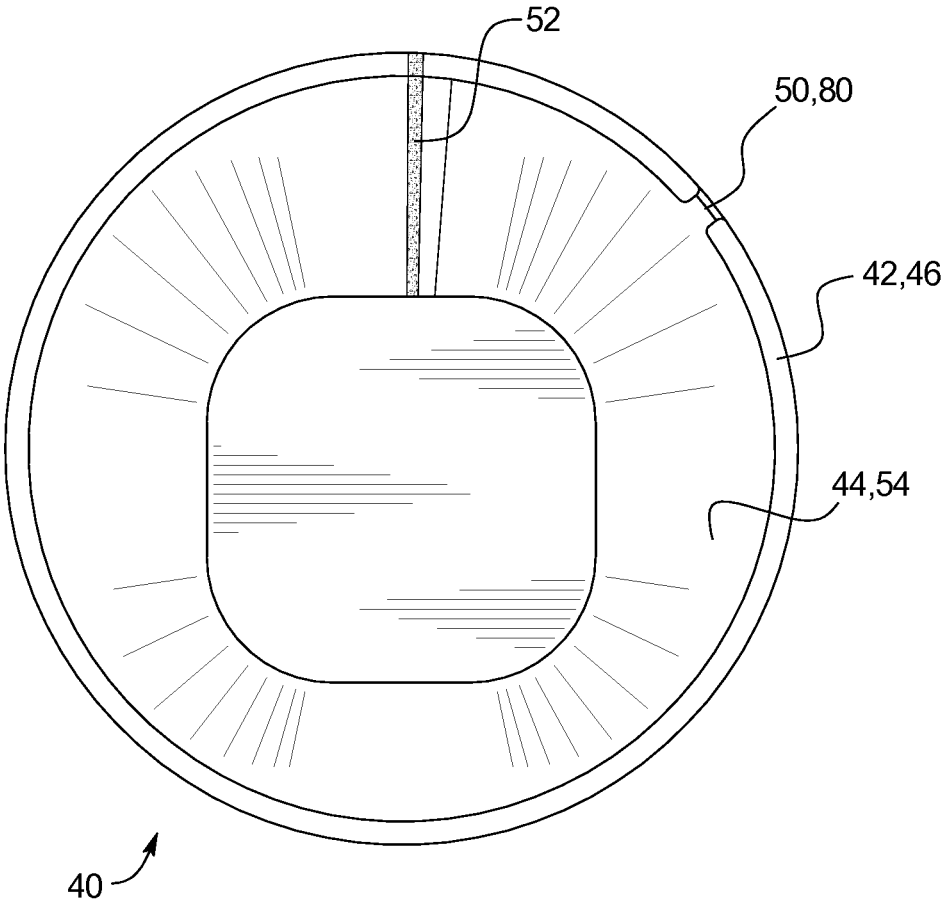
FIG. 7 illustrates a top view of one embodiment of the receptacle of the present invention.

FIG. 7 illustrates a top view of the receptacle 40. The receptacle 40 can include a mouth 42 for providing access to the consumable products within an interior. An annular bead 46 can be formed around the circumference of the mouth 42. The annular bead 46 at least partially extends in a radial direction towards the interior of the receptacle with respect to a wall of the receptacle 40. In an embodiment, the annular bead 46 can involve a roll of metal material having a radius of curvature of about one millimeter such that the annular bead extends about two millimeters away from a receptacle wall. The first end 24 of the connector may be inserted into an interior of the receptacle 40 such that the mouth 42 of the receptacle engages the annular ring 22 of the connector 20.

The flanges 28 may resiliently deform towards an interior of the connector and around the annular bead 46. When the annular bead 46 is located within the channel 29, the flanges 28 may spring back towards the wall of the receptacle 40. At the same time, the mouth 42 of the receptacle 40 may engage the ring 22 and the second end 26 may engage the inner surface of the lid 60. In an embodiment, the connector 20 has a maximum thickness of about three millimeters and the channel 29 extends up to about a millimeter therein. In this regard, the flanges 28 and the annular bead 46 can provide a snap-fit connection between the connector 20 and the receptacle 40 such that the first end 24 of the connector snaps into position to couple with the receptacle 40. This snap-fit connection can permanently couple the connector 20 to the receptacle 40.

Figure 5:
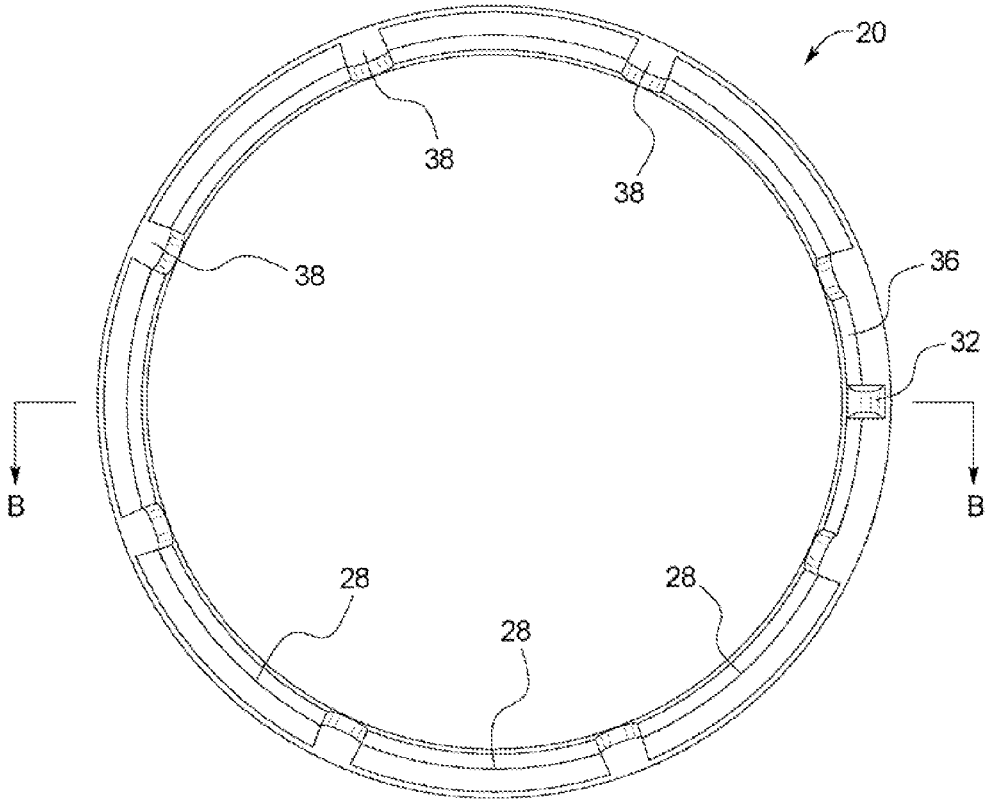
FIG. 5 illustrates a bottom view of the connector of FIG. 3.
Figure 6:
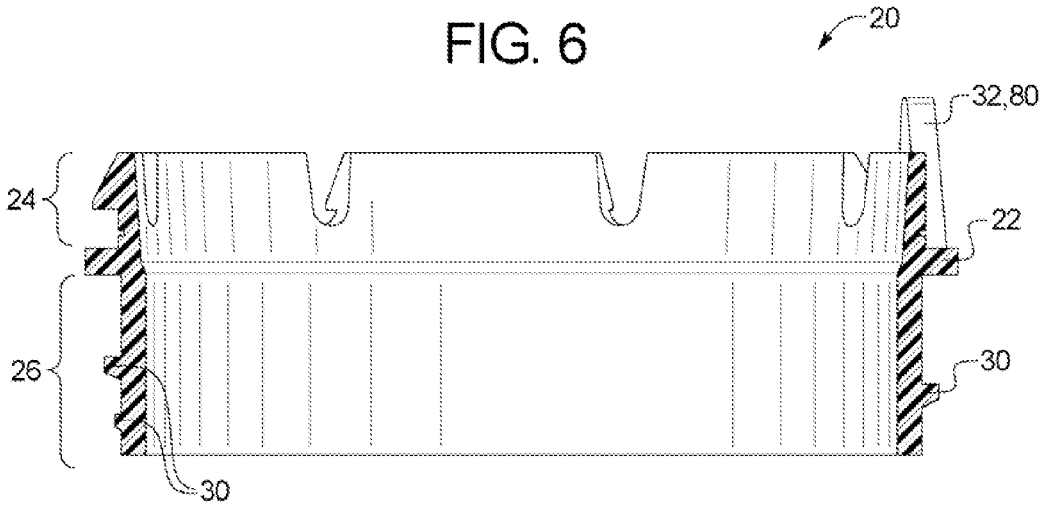
FIG. 6 illustrates a cross-sectional view of the connector of FIG. 5 along line B-B.

The housing 18 may include an alignment assembly 80 for aligning the connector 20 with respect to the receptacle 40. For example, as shown in FIG. 3 and FIG. 4A, the first end 24 of the connector 20 may also include at least one alignment flange 36 which is shaped differently from the plurality of flanges 28. The alignment flange may not resiliently deform like the flanges 28. Instead, the alignment flange 36 may include at least one rigid projection 32 along its length. In an embodiment, the rigid projection 32 extends along the entire length of the alignment flange 36. In another embodiment, the rigid projection extends only along a portion of the length of the alignment flange 36. As shown in FIG. 5, the rigid projection 32 has a maximum thickness that is greater than a maximum thickness of the alignment flange 36. In an embodiment, the maximum thickness of the rigid projection 32 is almost approximately equal to the thickness of the connector 20 at the annular ring 22 such that the rigid projection 32 is substantially flush with the annular ring 22.

Figure 8:
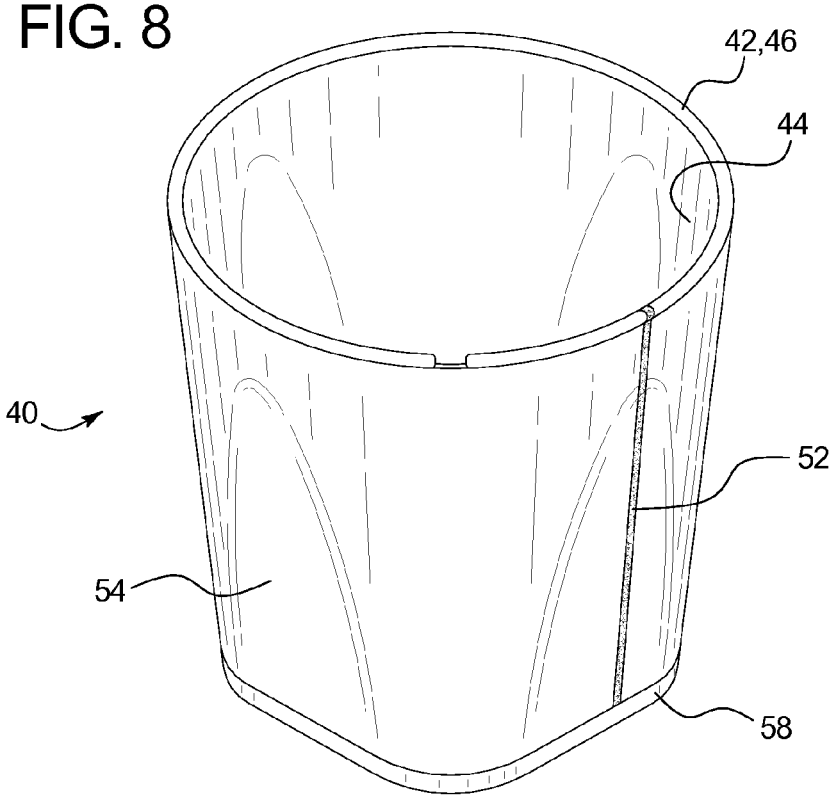
FIG. 8 illustrates a top perspective view of the receptacle of FIG. 7.
Figure 9:
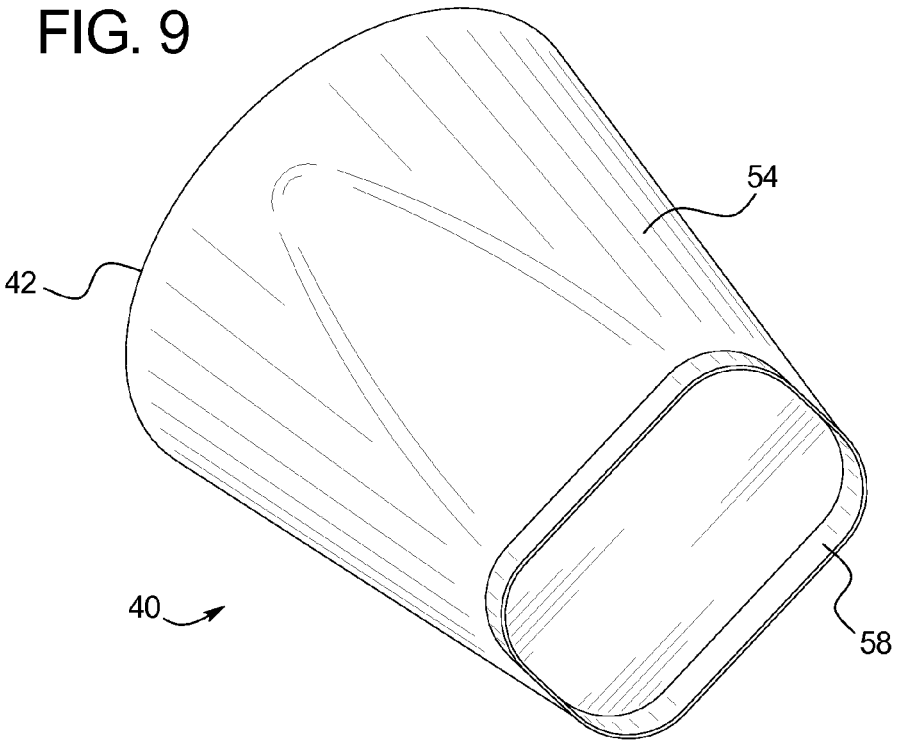
FIG. 9 illustrates a bottom perspective view of the receptacle of FIG. 7.

As shown in FIG. 7 and FIG. 8, the alignment assembly 80 may also include at least one notch 50 defined within the annular bead 46 of the receptacle 40. In an embodiment, the notch 50 is formed by completely removing or cutting out a portion of the annular bead 46. This can be done using a die cutting machine. In another embodiment, the notch 50 is formed by denting, shaping, or crimping a portion of the annular bead 46. The length and shaped of the notch 50 can correspond to the length and shape of the rigid projection 32 so that the notch can accommodate the projection 32 therein. In an embodiment, the notch 50 is die cut and has a length of approximately three millimeters.

The alignment assembly 80 may also prevent relative rotation between the connector 20 and the receptacle 40. More specifically, portions of the annular bead 46 along the receptacle which directly surround the notch 50 will engage each side of the rigid projection 32 such that the projection cannot rotate with respect to the annular bead 46. This ensures that the projection 32 remains within the notch 50. In this regard, the alignment assembly 80 prevents the connector 20 from rotating with respect to the receptacle 40 after the housing 18 is assembled. This way, the housing 18 may function as a cohesive unit when the lid 60 is twisted onto the housing 18 via the threaded connection.

It shall be understood that the alignment assembly 80 may include more than one alignment flange 36 and/or rigid projection 32 on the connector 20 and more than one notch on the receptacle, as long as the number of projections 32 match the number of notches 50. It shall also be understood that the alignment assembly can include notches 50 and projections 32 of any size or shape as long as the alignment assembly 80 prevents relative rotation between the connector 20 and the receptacle 40.

FIG. 10A and FIG. 10B illustrate further embodiments of the housing 18 where the housing is made from a unitary piece of metal material 54. In this embodiment, the housing 18 includes a metal outer thread 48 but may not include an annular bead 46 or notch 50 on a periphery of the mouth 42.

Figure 11:
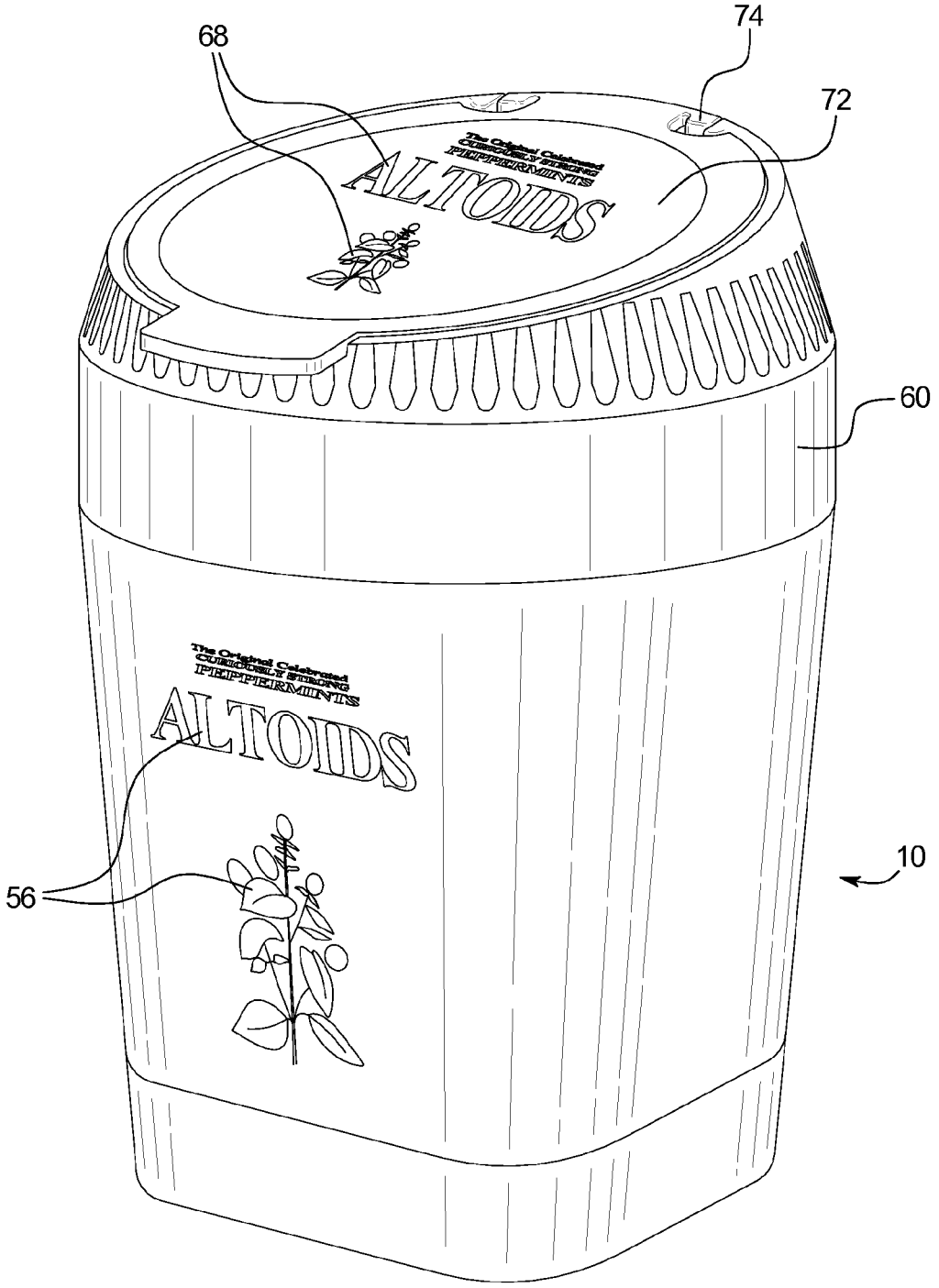
FIG. 11 illustrates a perspective view of an embodiment of an assembled container of the present invention.

As illustrated in FIG. 11, the assembled container 10 may include a lid 60, an insertable connector 20, and a receptacle 40 where the connector 20 is substantially concealed within the container 10. In other words, a consumer may only be able to see the annular ring 20 of the insertable connector 20 when the container 10 is fully assembled. However, a consumer can easily appreciate the sophisticated aesthetic of a metal receptacle 40. In an embodiment, the consumer can also easily notice a first indicia 68 on an outer surface of the lid 60 and a second indicia 56 on an outer surface of the housing 18.

In an embodiment, the first indicia 68 may be located on a top surface 70 of the lid 60. In another embodiment, the second indicia 56 may be located on a front wall of the housing 18. In a further embodiment, the alignment assembly 80 and the single threaded connection cooperate to ensure that the first indicia 68 must be positioned directly over the second indicia 56 such that both indicia 68, 56 can be easily read by a consumer from a front view of the container 10. For example, the alignment assembly 80 may prevent relative rotation between the connector 20 and the receptacle 40 such that the second indicia 56 must remain in a fixed spot on the housing 18 after the housing 18 is assembled.

In an embodiment, a long single thread may be provided on an inner surface of the lid and a long single thread may be provided on an outer surface of the housing. A set of long single threads between the lid 60 and the housing 18 can ensure that there is: (a) only one starting point at which the lid may begin to twist around the housing 18 (i.e. where the inner and outer threads meet), and (b) only one ending point at which the lid stops twisting with respect to the housing 18 (i.e. where the inner and outer threads end). This way, the first and second indicia 68 and 56 may be positioned with respect to the inner and outer threads 66 and 30, 48 respectively in a specific orientation. This orientation can ensure that when the lid 60 stops twisting around the housing 18, the first and second indicia 68 and 56 will be appropriately positioned with respect to one another. Therefore, the alignment assembly 80 and the set of single threads can promote graphic alignment of the first indicia 68 with respect to the second indicia 56 each time the lid 60 is twisted onto the housing 18.

The indicia 68, 56 may include logos, advertisements, branding information, nutritional information, product information, manufacturer information, or the like, or combinations thereof. The indicia may also be provided on the container 10 in various manners. In an embodiment, the indicia may be printed onto portions of the container. For example, the indicia may be printed on metal, plastic or paperboard portions of the container. In another embodiment, the indicia may be embossed or punched into a metal material 54 of the container 10. In a further embodiment, the indicia may be textured or molded into a plastic material 34 of the container 10. In a further embodiment, the indicia may be printed on a pressure sensitive material (e.g. sticker) and applied to an outer surface of the container 10.

In an embodiment, the lid may define at least two openings of differing size: a major opening and a minor opening. The presence of both a major opening and a minor opening allows differing quantities of products to be removed from the container in different ways. For example, a consumer can open the major opening to access a large amount of products in a container interior. The major opening provides easy reach-in access to the consumable products, and, therefore, easy removal of a large number of consumable products at once. Alternatively, a consumer can open the minor opening to access a small amount of products in the interior. The minor opening may be located on a side of the base of the lid. The minor opening can be sized to allow for dispensing of individual or a small number of products.

As discussed above, the top surface 70 of the lid 60 may define a plane that is at an angle with respect to a horizontal plane so as to create a sloped surface. The sloped top surface may provide better viewing for a first indicia 68. That is, a first indicia 68 can be applied to a sloped top surface 70 for increased visibility to a consumer from a front view of the container 10. The major opening may be located on the sloped top surface 70 so as to be increased, meaning the size of the major opening is made larger than a planar opening would allow.

In an embodiment, the housing 18 may be shaped in a variety of ways and can include a variety of second indicia 56. Similarly, the lid 60 may include a variety of first indicia 68. In each embodiment, the first indicia 68 is lined up with the second indicia 56 so that a consumer can easily read both from a front view of the container.

The present invention also include a method for assembling a consumable product container 10. The method includes providing a lid, a receptacle, and a connector. The receptacle 40 includes a metal material and defines an interior contacting a plurality of solid consumable products. The lid 60 includes a non-metal material and an inner thread 66. The connector 20 includes a non-metal material and an outer thread 30. The method also includes providing a connection for coupling the connector to the receptacle. The method further includes the steps of: (a) coupling the connector to the receptacle, and (b) twisting the lid 60 onto the connector 20 so as to connect the inner thread 66 with the outer thread 30.

Although not illustrated, the container 10 may include an induction seal. The induction seal may protect the consumable products, promote freshness, and extend the shelf life of the products. In an embodiment, the induction liner may seal around the mouth 42 of the receptacle. In another embodiment, the induction liner may seal around the first end 24 of the insertable connector 20. When a consumer first receives the container 10, the consumer can either open or remove the lid 60 before breaking the induction seal and exposing the consumable products. Conventional induction sealing techniques may be used, including such non-limiting examples as cold sealing, heat sealing utilizing a hot melt, heat activated adhesive or fusible substrate, room temperature sealing utilizing room temperature adhesives, or other induction sealing processes utilizing conductive foil systems. Alternatively, a conduction seal may be used utilizing conventional conduction sealing techniques may also be used.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A container comprising:

a lid comprising a non-metal material;

a connector coupled to the lid, the connector comprising a non-metal material having a first portion defining a plurality of flanges in series about a circumference of the first portion, the plurality of flanges comprising a plurality of resiliently deformable flanges and at least one rigid alignment flange that is shaped differently from each of the plurality of resiliently deformable flanges; and a receptacle formed from a metal material having an interior contacting a plurality of solid consumable products, wherein the plurality of flanges extends into and engages the interior to couple the connector and the receptacle, each of the plurality of resiliently deformable flanges engages a mouth of the receptacle in a snap fit.

2. The container of claim 1 wherein the receptacle further comprises an inert coating, the coating covering a portion of the metal material on the interior of the receptacle.

3. The container of claim 2 wherein the coating covers about 50% to about 100% of the metal material on the interior of the receptacle.

4. The container of claim 2 wherein the inert coating is a varnish approved by the Food and Drug Administration (FDA).

5. The container of claim 1 wherein the non-metal material comprises plastic.

6. The container of claim 1 further comprising a connection for removably coupling the connector to the lid comprising an outer thread on a second portion of the connector and an inner thread on the inner surface of the lid.

7. The container of claim 1 wherein the plurality of resiliently deformable flanges further defines a channel on the first portion of the connector, the channel receives at least one bead on the interior of the receptacle such that the first portion snaps into position to couple with the receptacle.

8. The container of claim 1 wherein the plurality of solid consumable products is selected from the group consisting of confectionery products and snack foods.

9. A container comprising:

a lid comprising an inner surface having a single inner thread;

a housing comprising a receptacle formed from a metal material and defining an interior contacting a plurality of solid consumable products; and a connector comprising:

a first portion defining a plurality of flanges in series about a circumference of the first portion, the plurality of flanges comprising a plurality of resiliently deformable flanges and at least one rigid alignment flange that is shaped differently from each of the plurality of resiliently deformable flanges, the plurality of flanges extending into the interior and engaging the interior to couple the connector to the receptacle, each of the plurality of resiliently deformable flanges engages a mouth of the receptacle in a snap fit; and a second portion having an outer surface defining a single outer thread, the outer and inner threads forming a threaded connection for coupling the lid to the housing.

10. The container of claim 9 wherein the lid comprises plastic.

11. The container of claim 9 wherein the connector comprises plastic.

12. The container of claim 9 further comprising a top surface on the lid comprising a first indicia, the outer surface on the housing comprising a second indicia, the first indicia oriented with respect to the inner thread and the second indicia oriented with respect to the outer thread so as to align the first indicia with the second indicia when the lid is coupled to the housing.

13. The container of claim 9 wherein the plurality of solid consumable products is selected from the group consisting of confectionery products and snack foods.

14. A method for assembling a container comprising the steps of:

providing (i) a lid comprising a non-metal material and having a single inner thread, (ii) a connector comprising a non-metal material and having a first portion defining a plurality of flanges in series about a circumference of the first portion, the plurality of flanges comprising a plurality of resiliently deformable flanges and at least one rigid alignment flange that is shaped differently from each of the plurality of resiliently deformable flanges, the connector further comprising a second portion having an outer surface defining a single outer thread, and (iii) a receptacle comprising a metal material and defining an interior contacting a plurality of solid consumable products;

inserting the first portion of the connector into the interior of the receptacle such that the plurality of flanges couples the connector to the receptacle, wherein each of the plurality of resiliently deformable flanges engages a mouth of the receptacle in a snap fit; and twisting the lid onto the connector so as to engage the inner thread of the lid with the outer thread of the connector.

15. The method of claim 14 wherein the receptacle further comprises an inert coating, the inert coating being applied to a portion of the metal material on the interior of the receptacle.

16. The method of claim 15 wherein the inert coating comprises a varnish that is approved by the Food and Drug Administration (FDA).

17. The container of claim 1 further comprising a notch defined in the mouth of the receptacle, the notch is configured to receive a rigid projection disposed on the at least one alignment flange.

18. The container of claim 1 wherein each of the plurality of resiliently deformable flanges extends radially outward to a greater extent than does the at least one alignment flange.

19. The container of claim 9 further comprising a notch defined in the mouth of the receptacle, the notch is configured to receive a rigid projection disposed on the at least one alignment flange.

20. The container of claim 9 wherein each of the plurality of resiliently deformable flanges extends radially outward to a greater extent than does the at least one alignment flange.

21. The method of claim 14 wherein inserting the first portion of the connector into the interior of the receptacle further comprises inserting a rigid projection disposed on the at least one alignment flange into a notch defined in the mouth of the receptacle.

22. The method of claim 14 wherein each of the plurality of resiliently deformable flanges extends radially outward to a greater extent than does the at least one alignment flange.

* * * * *